US007424752B2

(12) United States Patent
Antoniou

(10) Patent No.: US 7,424,752 B2
(45) Date of Patent: Sep. 16, 2008

(54) TOILET SYSTEM

(75) Inventor: Peter Antoniou, London (GB)

(73) Assignee: Odourbuster Limited, Ingatestone, Essex (GB)

( * ) Notice: Subject to any disclaimer, the term of this patent is extended or adjusted under 35 U.S.C. 154(b) by 424 days.

(21) Appl. No.: 10/534,422

(22) PCT Filed: Nov. 3, 2003

(86) PCT No.: PCT/GB03/04720

§ 371 (c)(1),
(2), (4) Date: May 5, 2005

(87) PCT Pub. No.: WO2004/042156

PCT Pub. Date: May 21, 2004

(65) Prior Publication Data

US 2006/0096014 A1 May 11, 2006

(30) Foreign Application Priority Data

Nov. 5, 2002 (GB) ..... 0225750.9

(51) Int. Cl.
*E03D 9/04* (2006.01)

(52) U.S. Cl. ..... 4/213

(58) Field of Classification Search ..... 4/213–217
See application file for complete search history.

(56) References Cited

U.S. PATENT DOCUMENTS

| | | | | | |
|---|---|---|---|---|---|
| 2,777,137 | A * | 1/1957 | McFadden | ..... | 4/213 |
| 4,011,608 | A * | 3/1977 | Pearson | ..... | 4/213 |
| 4,494,255 | A * | 1/1985 | Drummond | ..... | 4/213 |
| 4,790,036 | A * | 12/1988 | Vogeli et al. | ..... | 4/233 |
| 6,370,703 | B1 * | 4/2002 | Kim et al. | ..... | 4/216 |
| 2001/0034899 | A1 * | 11/2001 | Cardwell et al. | ..... | 4/216 |

* cited by examiner

*Primary Examiner*—Charles E. Phillips
(74) *Attorney, Agent, or Firm*—Chernoff, Vilhauer, McClung & Stenzel, LLP

(57) ABSTRACT

A toilet system comprising: a cistern for containing flush water; a toilet having a bowl, the bowl having one or more apertures which are in fluid communication with a water intake aperture of the toilet and through which flush water flows when the toilet is flushed; a conduit for transporting flush water from the cistern to the water intake aperture; and a gas removal device positioned around the conduit and defining an inner aperture through which the conduit passes, there being a peripheral space between the exterior of the conduit and an inner surface of the inner aperture, and the gas removal device being operable to suck gas into the device through the inner surface of the inner aperture.

35 Claims, 2 Drawing Sheets

TOILET SYSTEM

CROSS-REFERENCE TO RELATED APPLICATIONS

Figure 1:
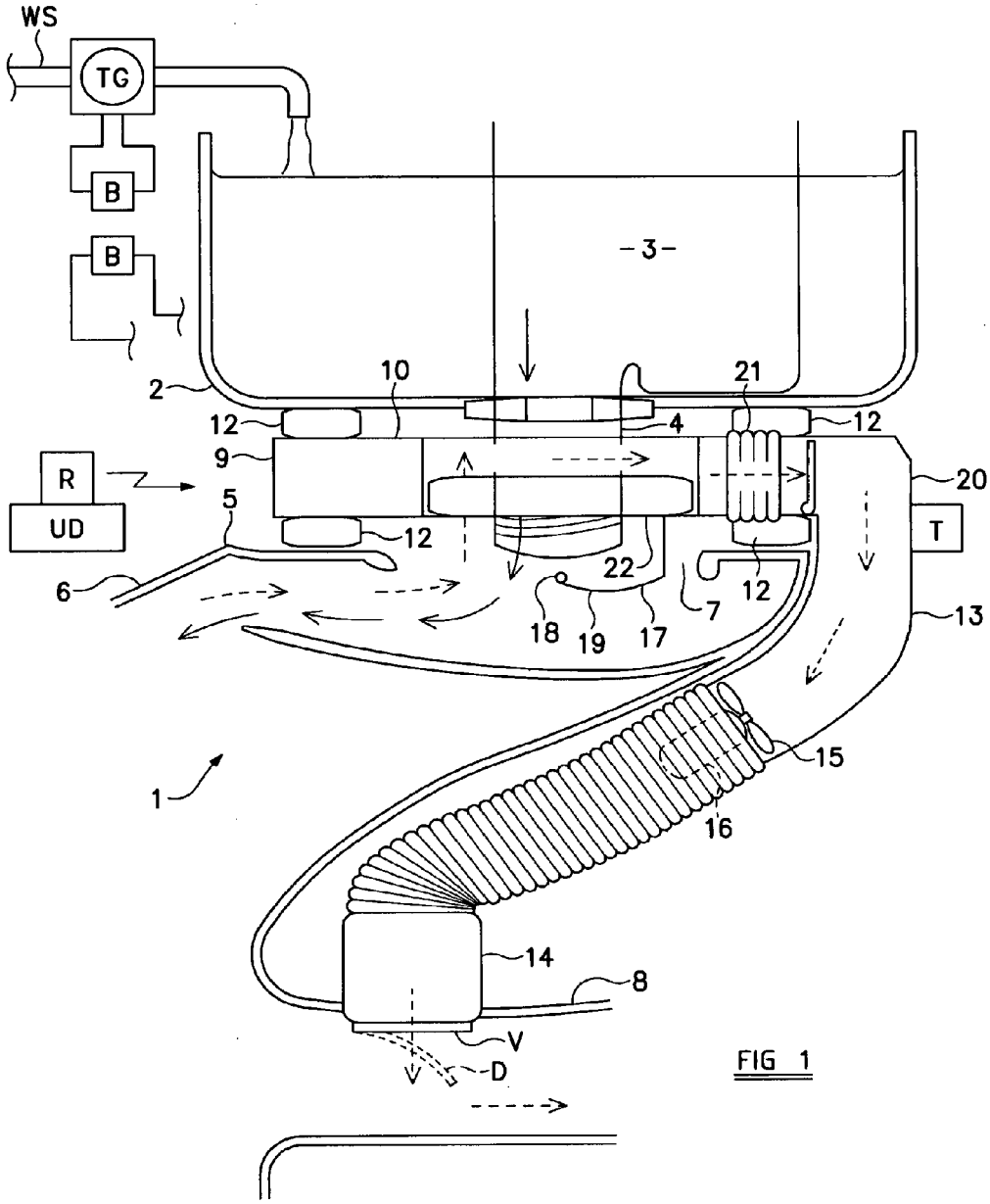

This application is the national stage of International Application No. PCT/GB03/004720 and claims benefit in accordance with 35 U.S.C. §119 of the priority of United Kingdom Patent Application No. GB 0225750.9, filed Nov. 5, 2002.

THIS INVENTION relates to a toilet system, and in particular concerns a toilet system comprising a gas removal device for removing gas therefrom. The present invention also provides a gas removal device which may be used with a wide variety of toilet systems.

It has been proposed in the past to provide a bathroom ventilation appliance that removes malodorous gas directly from the bowl of a toilet, by the extraction of air through the water jackets located around the rim of a toilet bowl. An example of such a system is disclosed in U.S. Pat. No. 5,386,594 (Hilton). In this document, a manifold is provided as an extension to a conduit that connects a water tank of a toilet system and the upper surface of the toilet itself. Hence, water passing from the water tank to the toilet passes through the manifold, and gas is sucked into the ventilation appliance through an inner surface of the manifold.

This approach suffers from several drawbacks. Firstly, the fact that the manifold acts as an extension to the conduit connecting the water tank and the toilet means that, in installing the ventilation appliance in a toilet system, the water tank must be raised through an additional height to accommodate the manifold.

Additionally, the manifold must be provided with connectors to connect the manifold to the conduit and to the upper surface of the toilet in an airtight fashion, and clearly this means that a different type of connector is required for each different type of conduit and/or toilet.

Further, the device disclosed in U.S. Pat. No. 5,386,594 comprises a complex and awkward "P-trap" for preventing the return of malodours air to the atmosphere following the deactivation of the gas removal mechanism. This P-trap mechanism requires a proportion of the water supplied to the toilet by the water tank at each flush to be diverted thereto, and due to the complexity of this system the P-trap mechanism is prone to failure.

It is an object of the present invention to seek to alleviate some or all of the above difficulties.

Accordingly, one aspect of the present invention provides a toilet system comprising: a cistern for containing flush water; a toilet having a bowl, the bowl having one or more apertures which are in fluid communication with a water intake aperture of the toilet and through which flush water flows when the toilet is flushed; a conduit for transporting flush water from the cistern to the water intake aperture; and a gas removal device positioned around the conduit and defining an inner aperture through which the conduit passes, there being a peripheral space between the exterior of the conduit and an inner surface of the inner aperture, and the gas removal device being operable to suck gas into the device through the inner surface of the inner aperture.

Advantageously, the gas removal device comprises an interface portion which is positioned around the conduit, the interface portion being provided with a pair of seals to seal the interface portion to the toilet and to the water tank.

Preferably, the gas removal device comprises a liquid detection mechanism to detect the flow of liquid through the conduit and cease the sucking of gas into the device upon such detection.

Conveniently, the liquid detection mechanism comprises a pair of electrically conductive contacts, having a gap defined therebetween, mounted on an arm such that the contacts are in a flow path of liquid carried by the conduit, an electrical connection between the contacts being made by the presence of water in the gap between the contacts.

Advantageously, following the ceasing of sucking of gas into the gas removal device due to the detection of a flow of liquid through the conduit, the sucking of gas into the gas removal device is resumed once no more liquid is detected flowing through the conduit.

Preferably, the system further comprises a use detection mechanism to detect use of the toilet and activate the gas removal device in response to such detection.

Conveniently, the use detection mechanism comprises a pressure sensor operable to detect the weight of a person using the toilet.

Advantageously, the use detection mechanism comprises a wireless connection to the gas removal device.

Preferably, the system further comprises a timer mechanism operable to deactivate the gas removal device after a predetermined time has elapsed following a time when the detection mechanism detects that use of the toilet has ceased.

Conveniently, the system further comprises a conduit for guiding gas removed by the gas removal device and feeding the removed gas into a soil stack of the toilet system.

Advantageously, the system further comprises a one-way valve which allows the removed gas to be fed into the soil stack from the conduit but prevents gas from entering the conduit from the soil stack.

Preferably, the one-way valve comprises a flexible diaphragm which blocks an aperture in the valve when gas attempts to flow from the soil stack to the conduit but distorts to allow gas to flow from the conduit to the soil stack.

Conveniently, an internal diameter of the inner aperture is at least 6.3 cm.

Advantageously, the gas removal device comprises one or more batteries to provide power to the gas removal device.

Preferably, the one or more batteries are rechargeable.

Conveniently, the system further comprises one or more turbines adapted to be located in an area of the toilet experiencing, in use, a fluid flow, the flow of fluid past the one or more turbines producing power; and a connector to supply power so produced to the gas removal device or a battery thereof.

Advantageously, the gas removal device comprises a body that is adapted to fit closely to a portion of the toilet, a part of the body having variable length.

Preferably, the part of the body having a variable length comprises a hollow, corrugated, flexible portion.

Another aspect of the present invention provides a toilet system comprising: a toilet having a bowl, the bowl having one or more apertures which are in fluid communication with a water intake aperture of the toilet and through which flush water flows when the toilet is flushed; a cistern for containing flush water, the cistern having an outlet through which flush water is ejected when the toilet is flushed, the cistern and the toilet being arranged such that, when flush water is ejected from the cistern through the outlet thereof, a flow of flush water follows a flow path and is received through the water intake aperture of the toilet; and a gas removal device having an inner aperture, the gas removal device being positioned around the flow path such that the flow path passes through the inner aperture and, when water flows along the flow path, an air gap exists between an inner surface of the inner aperture and an exterior of the flow.

Conveniently, the diameter of the inner aperture is at least 6.3 cm.

A further aspect of the present invention provides a gas removal device for use with a toilet system comprising a toilet having a bowl, the bowl having one or more apertures which are in fluid communication with a water intake aperture of the toilet and through which flush water flows when the toilet is flushed and a cistern for containing flush water, the cistern having an outlet through which flush water is ejected when the toilet is flushed, the cistern and the toilet being arranged such that, when flush water is ejected from the cistern through the outlet thereof, a flow of flush water follows a flow path and is received through the water intake aperture of the toilet, the gas removal device: defining an inner aperture; being adapted to be positioned around the flow path such that the flow path passes through the inner aperture and, when flush water flows through the flow path, an air gap exists between an inner surface of the inner aperture and an exterior of the flow; and being operable to suck gas into the device through an inner surface of the inner aperture.

Advantageously, an internal diameter of the inner aperture is at least 6.3 cm.

Another aspect of the present invention provides a gas removal device for removing gas from the bowl of a toilet, wherein: the device comprises an interface portion defining an aperture through which a flow path of flush water may pass; the device is operable to suck gas into the device through an inner surface of the interface portion; and the device comprises a liquid detection mechanism to detect the flow of liquid through the aperture and cease the sucking of gas into the device upon such detection.

Preferably, the liquid detection mechanism comprises a pair of electrically conductive contacts, having a gap defined therebetween, mounted on an arm, an electrical connection between the contacts being made by the presence of water in the gap between the contacts.

Conveniently, the device further comprises a use detection mechanism to detect use of the toilet and activate the gas removal device in response to such detection.

Advantageously, the use detection mechanism comprises a pressure sensor operable to detect the weight of a person using the toilet.

Preferably, the use detection mechanism comprises a wireless connection to the gas removal device.

Advantageously, the device further comprises a timer mechanism operable to deactivate the gas removal device after a predetermined time has elapsed following a time when the detection mechanism detects that use of the toilet has ceased, or after a predetermined time has elapsed following the initial activation of the gas removal device.

Conveniently, the device further comprises a conduit for guiding gas removed by the gas removal device and adapted to feed the removed gas into a soil stack of the toilet.

Advantageously, the device further comprises a one-way valve which allows the removed gas to be fed into the soil stack from the conduit but prevents gas from entering the conduit from the soil stack.

Preferably, the one-way valve comprises a flexible diaphragm which blocks an aperture in the valve when gas attempts to flow from the soil stack to the conduit but distorts to allow gas to flow from the conduit to the soil stack.

Conveniently, an internal diameter of the aperture is at least 6.3 cm.

Advantageously, the gas removal device comprises one or more batteries to provide power to the gas removal device.

Preferably, the one or more batteries are rechargeable.

Conveniently, the device further comprises: one or more turbines adapted to be located in an area of the toilet experiencing, in use, a fluid flow, the flow of fluid past the one or more turbines producing power; and a connector to supply power so produced to the gas removal device or a battery thereof.

Advantageously, the gas removal device comprises a body that is adapted to fit closely to a portion of the toilet, a part of the body having variable length.

Preferably, the part of the body having a variable length comprises a hollow, corrugated, flexible portion.

A further aspect of the present invention provides a gas removal device for removing gas from the bowl of a toilet, the device comprising: one or more turbines adapted to be located in an area of the toilet experiencing, in use, a fluid flow, the flow of fluid past the one or more turbines producing power; and a connector to supply power so produced to the gas removal device or a battery thereof.

Another aspect of the present invention provides a method of adapting a toilet system, the toilet system initially comprising a toilet having a bowl, the bowl having one or more apertures which are in fluid communication with a water intake aperture of the toilet and through which flush water flows when the toilet is flushed and a cistern for containing flush water, the cistern having an outlet through which flush water is ejected when the toilet is flushed, the cistern and the toilet being arranged such that, when flush water is ejected from the cistern through the outlet thereof, a flow of flush water follows a flow path and is received in the water intake aperture of the toilet, the method comprising the steps of: providing a gas removal device, the gas removal device defining an inner aperture and being operable to suck gas into the device through an inner surface of the inner aperture; and positioning the gas removal device around the flow path such that, when flush water flows along the flow path, an air gap exists between the inner surface of the inner aperture and an exterior of the flow.

Figure 2:
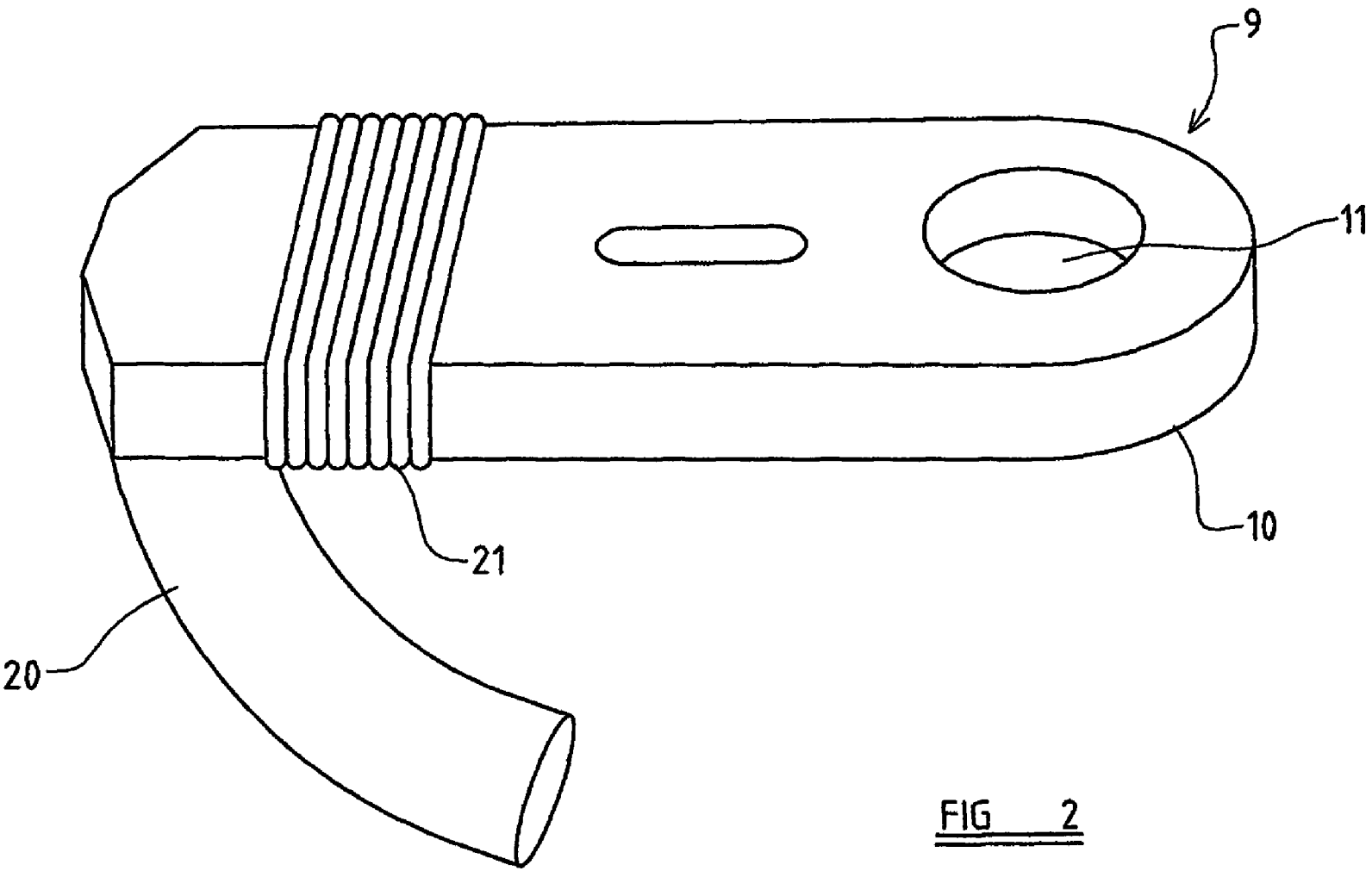

In order that the present invention may be more readily understood, embodiments thereof will now be described by way of example, with reference to the accompanying drawings, in which:

FIG. 1 is a schematic view of the toilet system embodying the present invention; and FIG. 2 shows a gas removal device embodying the present invention.

With reference firstly to FIG. 1, a toilet system 1 embodying the present invention comprises a water tank 2, which is adapted to hold a quantity of water 3 and which is provided with a substantially vertical conduit 4 extending downwardly therefrom. The water tank 2 is adapted to eject at least some of the water 3 held therein out of the water tank 2 through the conduit 4 when a flush of the toilet system 1 is required.

The toilet system 1 further comprises a toilet 5. The toilet 5 comprises a bowl 6, the bowl 6 having one or more apertures (not shown) on an inner surface thereof, preferably under a rim of the toilet bowl. When the toilet 5 is flushed, water is ejected from the apertures on the inner surface of the bowl 6 as part of the flushing procedure.

The toilet 5 is provided with a water intake aperture 7 on an upper surface thereof, and one or more channels are provided in the toilet to allow fluid communication between the apertures on the inner surface thereof and the water intake aperture 7. These channels are commonly referred to as the water jackets of the toilet 5.

The water tank 2 and the toilet 5 are arranged so that water passing downwardly through the conduit and ejected therefrom will be received in the water intake aperture 7 of the toilet 5.

Hence, it will be understood that, during a flush of the toilet system 1, water 3 is ejected downwardly from the water tank 2 through the conduit 4 and into the water intake aperture 7 of the toilet. The water then passes through the water jackets of the toilet and is ejected out of the apertures on the inner surface of the toilet bowl 6.

The toilet 5 is further provided with a soil stack 8, through which waste matter from the toilet is expelled.

The toilet system 1 described comprises conventional components.

The toilet system 1 further comprises a gas removal device 9. The gas removal device 9 comprises a substantially ring-shaped interface portion 10, which is flattened in shape and defines an inner aperture 11. The interface portion 10 is positioned between the water tank 2 and the toilet 5, such that the conduit 4 passes through the inner aperture 11 thereof, there being a peripheral space defined between the exterior of the conduit 4 and the inner surface of the inner aperture 11.

The interface portion 10 of the gas removal device 9 is provided with a pair of ring-shaped seals or gaskets 12, which are respectively provided on upper and lower surfaces of the interface portion 10 and form a seal between the upper surface of the lower surface of the interface portion 10 and the underside of the water tank 2, and between the lower surface of the interface portion 10 and the upper surface of the toilet 5.

The gas removal device 9 further comprises a conduit 13 which is connected to the interface portion 10. A gas intake port is defined on an inner surface of the inner aperture 11 of the gas removal device 9. The gas intake port is in fluid communication with the conduit 13.

The conduit 13 is airtight and connects the gas intake port of the interface portion 10 to a connector 14, which connects the conduit 13 to the soil stack 8 and places the conduit 13 in fluid communication therewith, preferably in a selective manner, as will be described below. The conduit 13 is preferably flexible, so that it can be distorted to accommodate different sizes of toilet or avoid any inconveniently-located items or fittings in the bathroom.

The gas removal device 9 is operable to suck gas into the device 9 through the gas intake port. To achieve this, a fan 15 is provided in the conduit 13, the fan 15 being powered by a motor 16, although any other suitable method of sucking in gas may be used as part of the present invention.

The toilet system 1 further comprises a use detection mechanism UD to detect use of the toilet 5 and to activate the gas removal device 9 in response to such detection.

The use detection mechanism UD may take any suitable form and may, for instance, comprise a motion sensor operable to detect the presence of a person in the region immediately above the seat of the toilet 5. Alternatively, the use detection mechanism UD may comprise a pressure sensor, which may be located in a suitable location to detect the weight of a person using the toilet 5.

As a further possibility, the use detection mechanism UD may comprise a switch which is mounted on a wall in the vicinity of the toilet system 1, or in another suitable location, so that a user of the toilet 5 can activate the gas removal device 9 manually. In preferred embodiments of the invention, a switch is provided which may be located beneath the seat of the toilet 5, thereby acting as a pressure sensor to detect use of the toilet 5 automatically, or may alternatively be mounted on a nearby wall and activated manually. It is envisaged that this will be found useful in situations where someone sitting on the toilet will not always necessitate use of the gas removal device 9, for instance in a household consisting mainly or entirely of women.

It is preferred, particularly in conjunction with this embodiment, that the use detection mechanism UD provided with a wireless connection R to the gas removal device 9. This is partially for convenience, and partially because users may often feel uneasy at the presence of electrical wires in a bathroom, as there may be a fear of receiving an electric shock.

Use of the toilet system 1 will now be described. The use detection mechanism detects the use of the toilet 5 and, as discussed above, the detection may take one of several different forms. Upon the detected use of the toilet the fan 15 is activated, and rotates, thereby sucking air into the gas removal device 9 through the air intake port. Hence, air will be sucked directly from the toilet bowl, through the water jackets of the toilet 5, into the inner aperture 11 of the gas removal device 9 by flowing into the peripheral gap defined between the inner surface of the inner aperture 11 and the exterior of the conduit 4, and into the gas intake port. The removed gas passes through the conduit 13, past the fan 15, and is deposited into the soil stack 8 by the connector 14.

It will be appreciated that the provision of the peripheral gap between the inner surface of the inner aperture 11 of the gas removal device 9 and the exterior of the conduit 4 means that the gas removal device 9 has little or no effect on the height of the water tank 2 with respect to the toilet 5. This is because the gas removal device 9 does not comprise an extension of the conduit 4, as disclosed in U.S. Pat. No. 5,386,594, but instead fits around the conduit 4.

In addition, the interface between the gas removal device 9 and the remaining components of the toilet system 1 is not critically dependent upon the diameter of the conduit 4. Indeed, if the inner aperture 11 of the gas removal device 9 is sufficiently large, the gas removal device 9 may be used with any suitably configured toilet system 1.

It is understood that the widest commonly used conduits have diameters of around 5 cm (2 inches). In preferred embodiments of the invention, therefore, the inner diameter of the inner aperture 11 of the gas removal device 9 is at least 6 cm (around 2 and one third inches) and more preferably at least 6.3 cm (around 2 and a half inches).

In addition, installation of the gas removal device 9 in an existing toilet system 1 is simple, since the gas removal device 9 is not actually fixed to the conduit 4. The interface portion 10 of the gas removal device 9 is simply placed between the upper surface of the toilet 5 and the lower surface of the water tank 2, and the water tank 2 is then simply lowered on to the interface portion 10, with the gaskets 12 forming appropriate seals between the upper surface of the toilet 5 and the lower surface of the interface portion 10, and between the upper surface of the interface portion 10 and the underside of the water tank 2.

It will be appreciated that the above-described embodiment provides a toilet system 1 and gas removal device 9 therefor, which discreetly removes malodorous gases from the bowl 6 of the toilet 5, during use of the toilet 5, with the gas removal device 9 being easily and flexibly integrated into the toilet system 1 as a whole.

In preferred embodiments of the invention, the gas removal device 9 further comprises a liquid detection mechanism 17 to detect the flow of liquid through the conduit 4. In the illustrated embodiment, the liquid detection mechanism 17 comprises a pair of electrically conductive contacts 18 mounted near one another on an arm 19, such that the contacts 18 are adjacent the open end of the conduit 4. The arm 19 is preferably flexible. When water strikes the contacts 18, the water forms a conductive bridge therebetween, thereby completing a circuit.

The gas removal device 9 is configured such that, when the liquid detection method 17 detects that liquid is flowing through the conduit 4, the sucking of gas into the device 9 is ceased, by deactivating the fan 15. This ensures that, during flushing of the toilet 5, liquid is not sucked into the gas intake port of the gas removal device 9, as this may block the conduit 13 or cause damage to the fan 15 or motor 16 of the gas removal device 9. It is also likely that a circuit board or other control device will be housed within the conduit 13, and clearly the ingress of water into the conduit 13 is also undesirable if this is the case.

In circumstance where a user of the toilet (e.g. a child) neglects to flush the toilet following use, the liquid detection mechanism 17 will not deactivate the gas removal device 9. Hence, in preferred embodiments of the invention, a timer mechanism T is provided to deactivate the gas removal device 9 after the elapsing of a predetermined period of time following activation thereof or after the elapsing of a predetermined period of time following determination, by the use detection mechanism UD that use of the toilet 5 has ceased.

The gas removal device 9 further comprises a body portion 20, which is adapted to fit to the exterior shape of the toilet 5. Preferably, the gas removal device 9 is fitted to a toilet such that the interface portion 10 and body portion 20 extend directly backwards from the conduit 4 and fit over the back edge of the toilet 5. In order to accommodate the widest possible variety of different shapes of toilet, a variable length portion 21 is provided to connect the interface portion 10 to the body portion 20. The variable length portion 21 may, for example, comprise a hollow, corrugated, flexible portion, whose length may be varied but still provides an airtight passage between the interface portion 10 and the body portion 20 of the gas removal device 9.

The provision of the variable length portion 21 also assists in ensuring that the gas removal device 9 may be used within the widest possible variety of different toilet systems. If, for example, the configuration of a particular toilet or the presence of other objects in a bathroom prevents the gas removal device 9, from being fitted in the above-described orientation, the variable length portion 21 will increase the chances of the gas removal device 9 being able to be fitted in a sideways or other orientation from the conduit 4.

In preferred embodiments of the present invention, the connector 14 that connects the conduit 13 to the soil stack 8 comprises a one-way valve V, which allows gas to pass from the conduit 13 into the soil stack 8 but which prevents the passage of gas from the soil stack 8 into the conduit 13. Advantageously, this one-way valve comprises a flexible diaphragm D, which blocks an aperture in the valve 14 when gas attempts to flow from the soil stack 8 to the conduit 13, but distorts to allow gas to flow from the conduit 13 to the soil stack 8.

The gas removal device 9 may optionally be powered by a mains connection, or may be battery powered. In battery powered embodiments, two rechargeable batteries B may be provided, one of which can be recharged while the other is in use.

FIG. 1 depicts an annular float 22, which may be provided within the inner aperture 11 of the gas removal device 9. The float 22 is configured so that if the water level in the toilet rises to the toilet rim (for instance, due to a blockage or malfunction), and water enters the inner aperture 11 from below, the float 22 will float on the surface of the rising water and rise into a position where it blocks the gas intake port of the gas removal device 9. Hence, in the event of the gas removal device 9 being flooded with water from below, the float 22 will prevent the water entering the gas intake port.

In advantageous embodiments of the invention, one or more turbines or other power generation elements TG are placed in the flow path of an inflow connection WS to the water tank 2 from a mains water supply. In these embodiments, the arrangement is such that the flow of water into the water tank 2 from the mains water supply causes the power generation elements to generate power, which is then supplied to the gas removal device 9 or to a battery B thereof.

FIG. 2 shows a perspective view of the interface portion 10 and body portion 20 of the gas removal device 9.

It will be understood that the present invention provides a system for removal of malodorous gases from a toilet which is flexible, effective and simple to install.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A toilet system comprising:

a cistern for containing flush water;

a toilet having a bowl, the bowl having one or more apertures which are in fluid communication with a water intake aperture of the toilet and through which flush water flows when the toilet is flushed;

a conduit for transporting flush water from the cistern to the water intake aperture; and a gas removal device positioned around the conduit and defining an inner aperture through which the conduit passes, there being a peripheral space between the exterior of the conduit and an inner surface of the inner aperture, the gas removal device being operable to suck gas into the device through the inner surface of the inner aperture and comprising a liquid detection mechanism to detect the flow of liquid through the conduit and cease the sucking of gas into the device upon such detection.

2. A system according to claim 1, wherein the gas removal device comprises an interface portion which is positioned around the conduit, the interface portion being provided with a pair of seals to seal the interface portion to the toilet and to the water tank.

3. A system according to claim 1, wherein the liquid detection mechanism comprises a pair of electrically conductive contacts, having a gap defined therebetween, mounted on an arm such that the contacts are in a flow path of liquid carried by the conduit, an electrical connection between the contacts being made by the presence of water in the gap between the contacts.

4. A system according to claim 1, wherein following the ceasing of sucking of gas into the gas removal device due to the detection of a flow of liquid through the conduit, the sucking of gas into the gas removal device is resumed once no more liquid is detected flowing through the conduit.

5. A system according to claim 1, further comprising a use detection mechanism to detect use of the toilet and activate the gas removal device in response to such detection.

6. A system according to claim 5, wherein the use detection mechanism comprises a pressure sensor operable to detect the weight of a person using the toilet.

7. A system according to claim 5, wherein the use detection mechanism comprises a wireless connection to the gas removal device.

8. A system according to claim 5, further comprising a timer mechanism operable to deactivate the gas removal device after a predetermined time has elapsed following a time when the detection mechanism detects that use of the toilet has ceased.

9. A system according to claim 1, further comprising a conduit for guiding gas removed by the gas removal device and feeding the removed gas into a soil stack of the toilet system.

10. A system according to claim 9, further comprising a one-way valve which allows the removed gas to be fed into the soil stack from the conduit but prevents gas from entering the conduit from the soil stack.

11. A system according to claim 10, wherein the one-way valve comprises a flexible diaphragm which blocks an aperture in the valve when gas attempts to flow from the soil stack to the conduit but distorts to allow gas to flow from the conduit to the soil stack.

12. A system according to claim 1, wherein an internal diameter of the inner aperture is at least 6.3 cm.

13. A system according to claim 1, wherein the gas removal device comprises one or more batteries to provide power to the gas removal device.

14. A system according to claim 13, wherein the one or more batteries are rechargeable.

15. A system according to claim 1, further comprising one or more turbines adapted to be located in an area of the toilet experiencing, in use, a fluid flow, the flow of fluid past the one or more turbines producing power, and a connector to supply power so produced to the gas removal device or a battery thereof.

16. A system according to claim 1, wherein the gas removal device comprises a body that is adapted to fit closely to a portion of the toilet, a part of the body having variable length.

17. A system according to claim 16, wherein the part of the body having a variable length comprises a hollow, corrugated, flexible portion.

18. A toilet system comprising:

a toilet having a bowl, the bowl having one or more apertures which are in fluid communication with a water intake aperture of the toilet and through which flush water flows when the toilet is flushed;

a cistern for containing flush water, the cistern having an outlet through which flush water is ejected when the toilet is flushed, the cistern and the toilet being arranged such that, when flush water is ejected from the cistern through the outlet thereof, a flow of flush water follows a flow path and is received through the water intake aperture of the toilet; and a gas removal device having an inner aperture, the gas removal device being positioned around the flow path such that the flow path passes through the inner aperture and, when water flows along the flow path, an air gap exists between an inner surface of the inner aperture and an exterior of the flow, the gas removal device being operable to suck gas into the device through the inner surface of the cistern outlet, and comprising a liquid detection mechanism to detect the flow of liquid through the inner aperture and cease the sucking of gas into the device upon such detection.

19. A system according to claim 18, wherein the diameter of the inner aperture is at least 6.3 cm.

20. A gas removal device for use with a toilet system comprising a toilet having a bowl, the bowl having one or more apertures which are in fluid communication with a water intake aperture of the toilet and through which flush water flows when the toilet is flushed and a cistern for containing flush water, the cistern having an outlet through which flush water is ejected when the toilet is flushed, the cistern and the toilet being arranged such that, when flush water is ejected from the cistern through the outlet thereof, a flow of flush water follows a flow path and is received through the water intake aperture of the toilet, the gas removal device:

defining an inner aperture;

being adapted to be positioned around the flow path such that the flow path passes through the inner aperture and, when flush water flows through the flow path, an air gap exists between an inner surface of the inner aperture and an exterior of the flow;

being operable to suck gas into the device through an inner surface of the inner aperture; and comprising a liquid detection mechanism to detect the flow of liquid through the cistern outlet and cease the sucking of gas into the device upon such detection.

21. A device according to claim 20, wherein an internal diameter of the inner aperture is at least 6.3 cm.

22. A device according to claim 20, wherein the liquid detection mechanism comprises a pair of electrically conductive contacts, having a gap defined therebetween, mounted on an arm, an electrical connection between the contacts being made by the presence of water in the gap between the contacts.

23. A device according to claim 20, further comprising a use detection mechanism to detect use of the toilet and activate the gas removal device in response to such detection.

24. A device according to claim 23, wherein the use detection mechanism comprises a pressure sensor operable to detect the weight of a person using the toilet.

25. A device according to claim 23, wherein the use detection mechanism comprises a wireless connection to the gas removal device.

26. A device according to claim 23, further comprising a timer mechanism operable to deactivate the gas removal device after a predetermined time has elapsed following a time when the detection mechanism detects that use of the toilet has ceased, or after a predetermined time has elapsed following the initial activation of the gas removal device.

27. A device according to claim 20, further comprising a conduit for guiding gas removed by the gas removal device and adapted to feed the removed gas into a soil stack of the toilet.

28. A device according to claim 27, further comprising a one-way valve which allows the removed gas to be fed into the soil stack from the conduit but prevents gas from entering the conduit from the soil stack.

29. A device according to claim 28, wherein the one-way valve comprises a flexible diaphragm which blocks an aperture in the valve when gas attempts to flow from the soil stack to the conduit but distorts to allow gas to flow from the conduit to the soil stack.

30. A device according to claim 20, wherein the gas removal device comprises one or more batteries to provide power to the gas removal device.

31. A device according to claim 30, wherein the one or more batteries are rechargeable.

32. A device according to claim 20, further comprising:

one or more turbines adapted to be located in an area of the toilet experiencing, in use, a fluid flow, the flow of fluid past the one or more turbines producing power; and a connector to supply power so produced to the gas removal device or a battery thereof.

33. A device according to claim 20, wherein the gas removal device comprises a body that is adapted to fit closely to a portion of the toilet, a part of the body having variable length.

34. A device according to claim 33, wherein the part of the body having a variable length comprises a hollow, corrugated, flexible portion.

35. A method of adapting a toilet system, the toilet system initially comprising a toilet having a bowl, the bowl having one or more apertures which are in fluid communication with a water intake aperture of the toilet and through which flush water flows when the toilet is flushed and a cistern for containing flush water, the cistern having an outlet through which flush water is ejected when the toilet is flushed, the cistern and the toilet being arranged such that, when flush water is ejected from the cistern through the outlet thereof, a flow of flush water follows a flow path and is received in the water intake aperture of the toilet, the method comprising the steps of:

providing a gas removal device, the gas removal device defining an inner aperture, being operable to suck gas into the device through an inner surface of the inner aperture, and comprising a liquid detection mechanism to detect the flow of liquid through the cistern outlet and cease the sucking of gas into the device upon such detection; and positioning the gas removal device around the flow path such that, when flush water flows along the flow path, an air gap exists between the inner surface of the inner aperture and an exterior of the flow.

* * * * *